US011473773B1

(12) United States Patent
Bodapati

(10) Patent No.: US 11,473,773 B1
(45) Date of Patent: Oct. 18, 2022

(54) STEAM SEPARATOR FOR BOILER

(71) Applicant: Superior Boiler Works, Inc., Hutchinson, KS (US)

(72) Inventor: Sundeep Bodapati, Richmond, VA (US)

(73) Assignee: Superior Boiler Works, Inc., Hutchinson, KS (US)

( * ) Notice: Subject to any disclaimer, the term of this patent is extended or adjusted under 35 U.S.C. 154(b) by 0 days.

(21) Appl. No.: 17/715,229

(22) Filed: Apr. 7, 2022

(51) Int. Cl.
*F22B 37/26* (2006.01)

(52) U.S. Cl.
CPC ..... *F22B 37/261* (2013.01)

(58) Field of Classification Search
CPC ..... F22B 37/261; F22B 37/26; F22B 37/30; F22B 37/303; F22B 37/22; F22B 37/266; F22B 37/322
USPC ..... 122/34, 488–492
See application file for complete search history.

(56) References Cited

U.S. PATENT DOCUMENTS 454,390 A * 6/1891 Thornycroft ..... F22B 37/303 122/491
824,104 A * 6/1906 Edson ..... C10G 7/00 196/119
1,931,544 A * 10/1933 Hobbs ..... F22B 37/22 122/491
2,161,031 A 6/1939 Fletcher
2,320,343 A * 6/1943 Bailey ..... F22B 37/322 55/440
2,743,709 A * 5/1956 Armacost ..... F22B 37/322 122/411
2,811,144 A * 10/1957 Raynor ..... F22B 33/14 122/488
2,822,060 A * 2/1958 Udovich ..... B01D 45/12 55/459.1
3,163,265 A * 12/1964 Waite ..... F23M 5/00 122/494
3,256,865 A * 6/1966 Modrak ..... B01D 45/08 122/491
3,370,574 A * 2/1968 Hohnholt ..... F22B 37/303 122/491
3,373,544 A * 3/1968 Catlin ..... F22B 37/266 122/459
3,516,391 A * 6/1970 Rawdon ..... F22B 37/283 122/491
3,547,085 A 12/1970 Kovacik et al.
3,849,095 A * 11/1974 Regehr ..... B01D 45/08 55/440
4,006,486 A * 2/1977 Vaughn ..... G02B 23/2476 122/435

(Continued)

FOREIGN PATENT DOCUMENTS

CH 494057 A * 7/1970
GB 504448 4/1939
GB 547413 A * 8/1942

*Primary Examiner* — Ko-Wei Lin
(74) *Attorney, Agent, or Firm* — Williams Mullen; Thomas F. Bergert

(57) ABSTRACT

A steam separator for a boiler includes an upper support rail assembly and an integrated baffle unit. Rail assembly clips can be secured to the upper support rail assembly for retaining an edge of one or more baffle panels. The integrated baffle unit can include a bottom tray assembly with a bottom baffle panel and one or more side baffle panels. The side baffle panels can be maintained within a bottom tray clip and/or a rail assembly clip.

19 Claims, 5 Drawing Sheets

(56) References Cited

U.S. PATENT DOCUMENTS

| | | | | | |
|---|---|---|---|---|---|
| 4,123,237 | A * | 10/1978 | Zipay | B01D 45/16 | 122/491 |
| 4,302,227 | A | 11/1981 | Miller | | |
| 5,061,304 | A * | 10/1991 | Gorzegno | B01D 45/12 | 122/34 |
| 5,271,753 | A * | 12/1993 | Akel | F22B 37/303 | 55/440 |
| 7,896,937 | B2 * | 3/2011 | Miemiec | B04C 3/06 | 55/444 |
| 9,851,097 | B2 * | 12/2017 | Rop | F22B 37/26 | |
| 2009/0205489 | A1 * | 8/2009 | Miemiec | B01D 50/20 | 96/392 |

* cited by examiner

Fig. 6
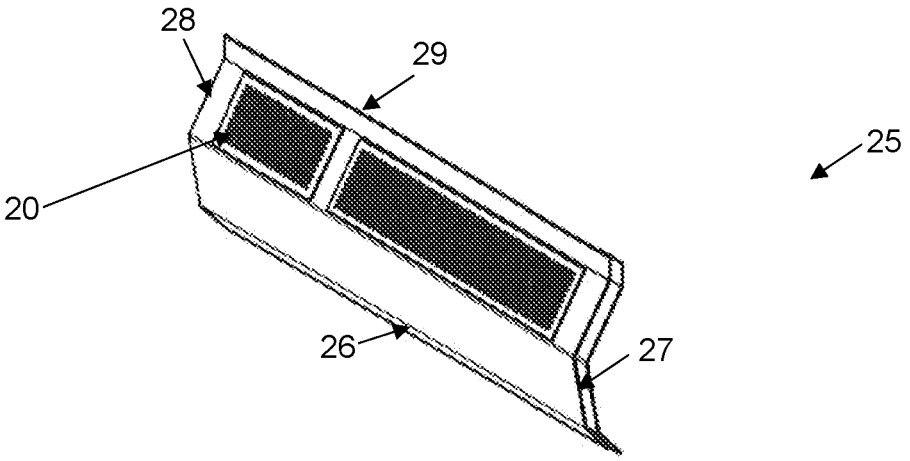
Fig. 7
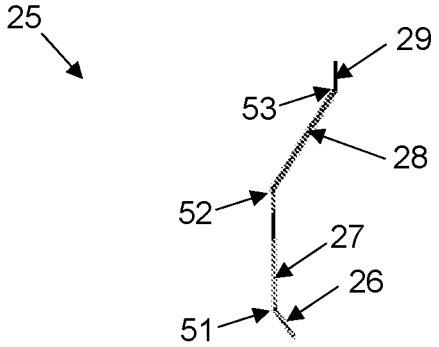
Fig. 8
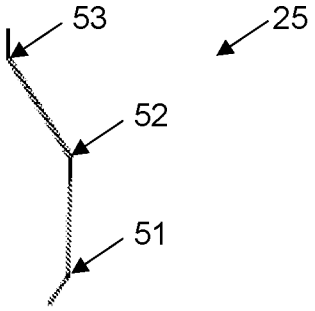
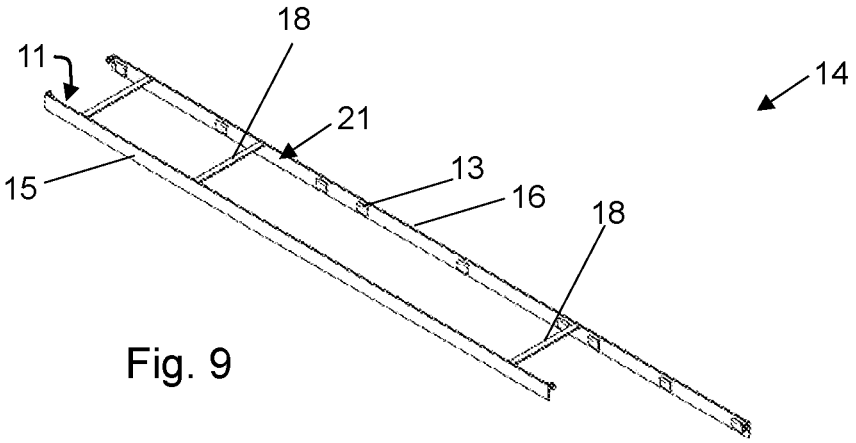
Fig. 9

STEAM SEPARATOR FOR BOILER

TECHNICAL FIELD

The present disclosure relates to boilers, and more particularly to a steam separator for a boiler.

BACKGROUND

A steam separator is a device that removes water vapor from steam. Such removal is useful in order to increase the thermal efficiency of a steam-based engine or turbine, among other things. Within some boilers, the separation of steam from water can be accomplished by using a large steam drum approximately half full of water, where gravity facilitates the separation of water droplets from the steam. Within high capacity, high pressure boilers, steam-water separation within the boiler drum can be facilitated with a mechanical steam-water separator. The separator can include screens and baffles that facilitate downward directional flow of the water droplets and a more even distribution of the steam-water mixture. With such devices, the steam entering a boiler drum strikes the baffle plates and the heavier water particles are directed to the bottom of the separator. The separated dry steam can then be passed to a turbine, a steam turbine or other steam applications through an outlet pipe.

Traditionally, steam within a boiler has been separated using baffle walls or panels that are secured to a boiler drum using nuts and bolts. Ordinarily, the water level within the drum is approximately at the horizontal center line and the metal bolts and nuts can become significantly worn or corroded over time, making manual replacement very difficult. Additionally, the sizing of the materials is not always accurate, resulting in misaligned bolt openings on adjacent pieces. As these elements are typically connected manually by a person who has entered the drum, fixing any misalignment and/or removing any corroded or stuck hardware can prove to be very difficult.

SUMMARY

Embodiments of the presently disclosed device address past challenges as described above and provide a steam separator for a boiler with a modular baffle system that does not rely on bolt/nut attachments for securing baffles within a steam boiler drum. In various embodiments, the presently disclosed device includes an upper support rail assembly, lower and side spacers, formed/bent baffle plates and clips for permitting modular assembly within a steam drum. The baffles are held in place by their own weight and fewer or no bolts/nuts are required.

As provided in the present disclosure, embodiments of the steam separator include an upper support rail assembly and an integrated baffle unit. Rail assembly clips can be secured to the upper support rail assembly for retaining an edge of one or more baffle panels. The integrated baffle unit can include a bottom baffle panel and one or more side baffle panels. The bottom baffle panel can be part of a bottom tray assembly. The side baffle panels can be maintained within a bottom tray clip or a rail assembly clip.

BRIEF DESCRIPTION OF THE DRAWINGS

FIG. 6 is a perspective view of a side baffle panel in accordance with embodiments of the present disclosure.

FIGS. 7 and 8 are right and left side views, respectively, of the baffle panel in accordance with embodiments of the present disclosure.

FIG. 9 is a perspective view of an upper rail assembly of a steam separator in accordance with embodiments of the present disclosure.

DETAILED DESCRIPTION OF EMBODIMENTS

Figure 1:
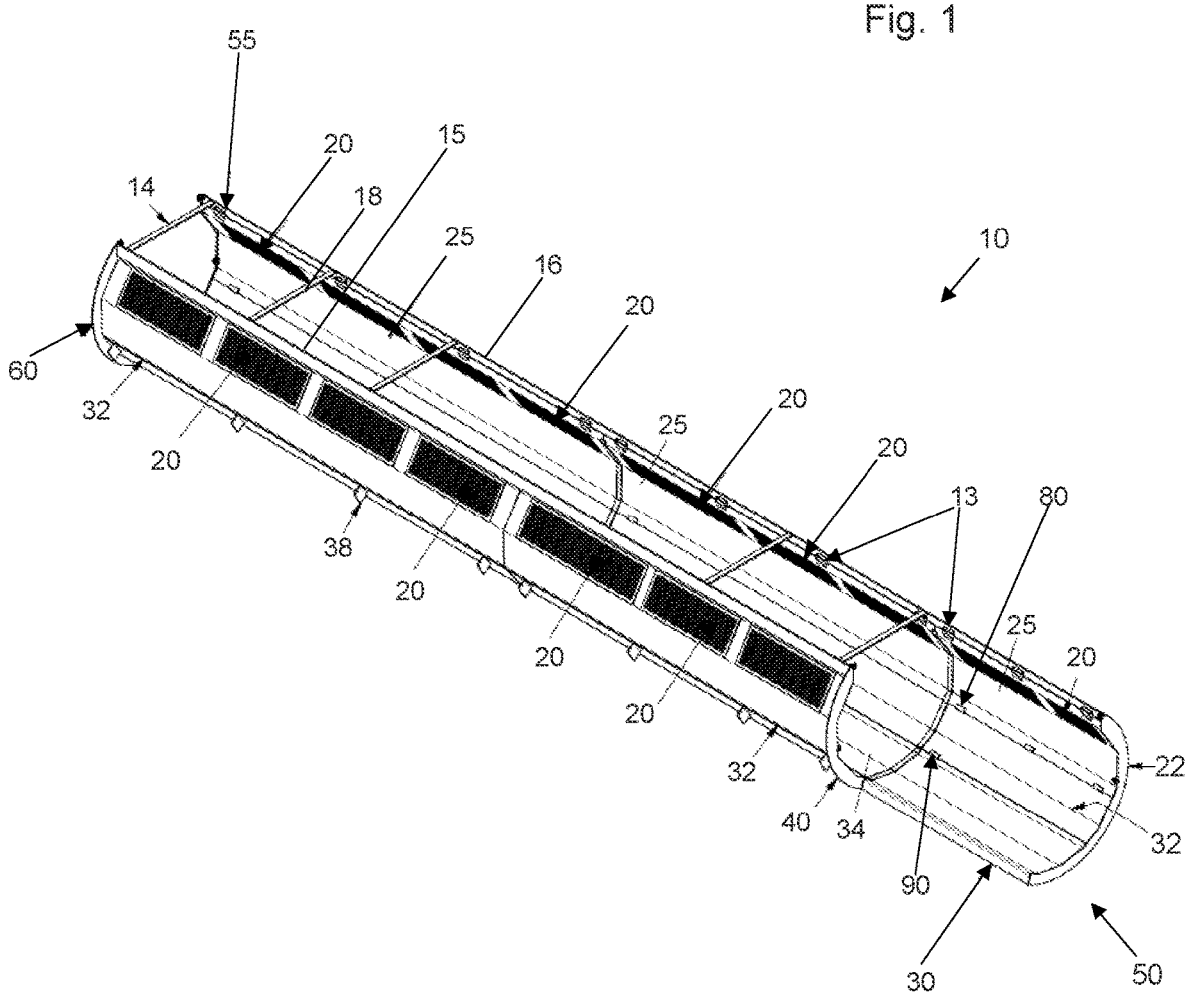
FIG. 1 is a perspective view of elements of a steam separator according to embodiments of the present disclosure.
Figure 2:
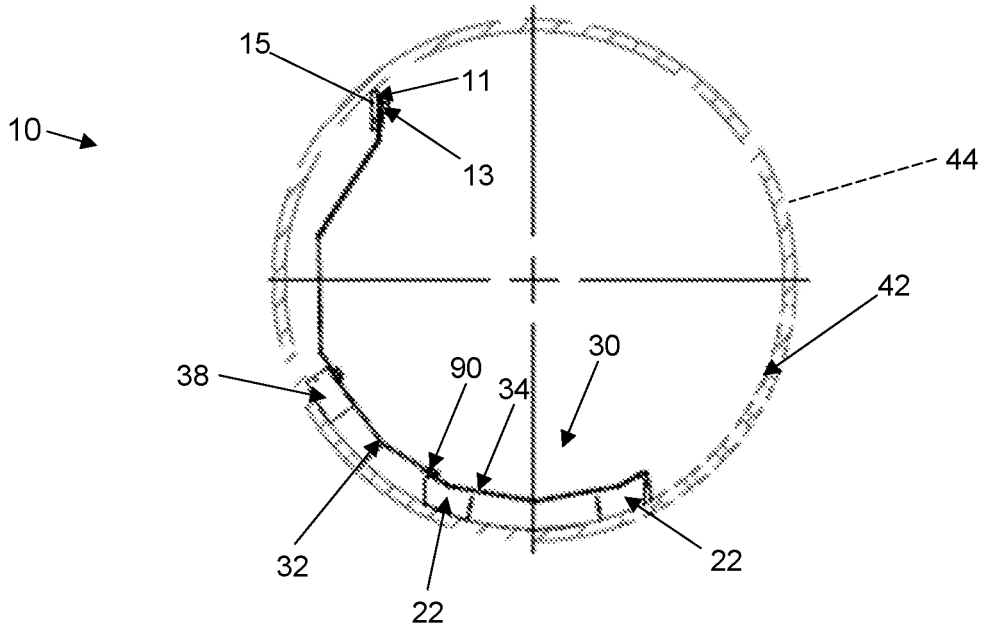
FIG. 2 is a side view of elements of a steam separator during assembly within a boiler drum according to embodiments of the present disclosure.
Figure 3:
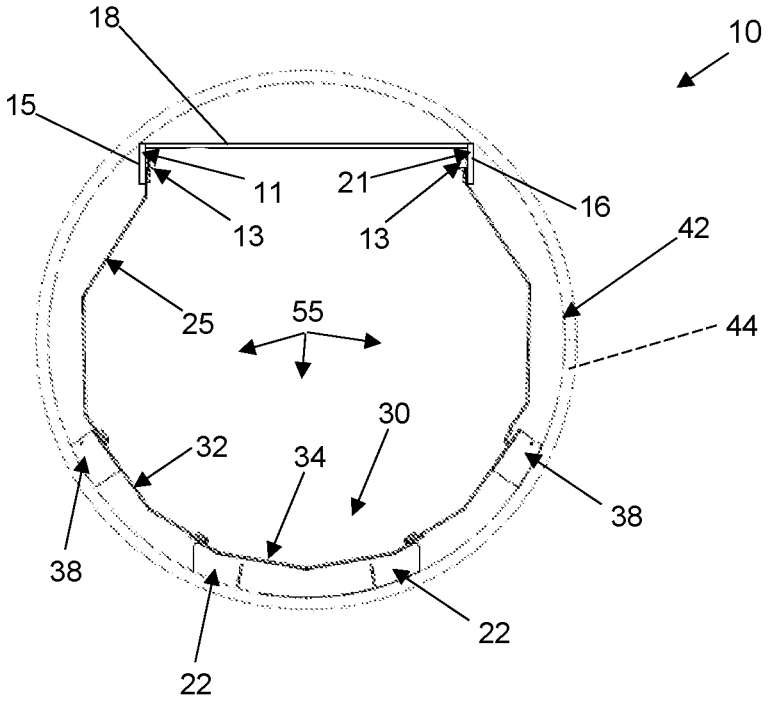
FIGS. 3 and 4 are side views of elements of a steam separator after assembly within a boiler drum according to embodiments of the present disclosure.

As shown in FIGS. 1 through 10, embodiments of the present disclosure provide a steam separator assembly 10 for a boiler drum 44, including an upper support rail assembly 14 having opposing rails 15, 16. In various embodiments, opposing rail 15 has an inner wall 11, opposing rail 16 has an inner wall 21 and one or more transverse bracket supports 18 extends from rail 15 to opposing rail 16. One or more rail assembly clips 13 can be secured to the upper support rail assembly 14, such as by securing the clip(s) 13 to the inner walls 11, 21 of the rails 15, 16, respectively. The upper support rail assembly 14 can be secured within boiler drum 44, as shown in FIGS. 2 and 3, for example. The rail assembly clips 13 can be formed with a slot between two walls for receiving an edge of a baffle panel (e.g., 25) as described elsewhere herein. The rail assembly clips 13 may permit sliding engagement with the baffle panel edge within the slot without latching the baffle panel edge, to permit ease of installation and disassembly, for example. In this way, the baffle panel may be maintained securely by the rail assembly clips 13 without permanent connection. The rail assembly clips 13 can be secured to the upper support rail assembly 14 using hardware such as a nut and bolt, for example, or by welding or other securing method.

As shown in FIGS. 1 through 5, embodiments of the steam separator assembly 10 can further include a bottom tray assembly 30 having a bottom baffle panel 34 and one or more bottom tray clips 90 secured to the bottom baffle panel 34. Side baffle panels 32 can be maintained within one or more such clips 90. In various embodiments, one or more side baffle panels 32, 25 can be maintained with a bottom tray clip 90 and/or within one of the rail assembly clips 13, supporting themselves via their weight and without nuts and bolts or similar attachment mechanisms. It will be appreciated that as disclosed herein, the side baffle panels 25 and/or 32 and the bottom baffle panel 34 form an integrated baffle unit 55. The bottom tray clips 90 can be formed with a slot between two walls for receiving an edge of a baffle panel (e.g., 25, 32). The bottom tray clips 90 may permit sliding engagement of a baffle panel within the slot without latching the baffle panel, to permit ease of installation and disassembly, for example. In this way, the baffle panel may be maintained securely by the rail assembly clips 13 without permanent connection. The bottom tray clips 90 can be secured to the bottom baffle panel 90 using hardware such as a nut and bolt, for example, or by welding or other securing method.

As further shown in FIGS. 1 through 5, embodiments of the bottom tray assembly 30 of the steam separator assembly 10 can include one or more lower spacers 22 positioned between the bottom baffle panel 34 and the inner surface 42 of the boiler drum 44. The bottom baffle panel 34 is positioned atop the lower spacer(s) 22. In various embodiments, the lower spacers 22 and the upper support rail assembly 14 are securable to or maintainable within the boiler drum inner surface 42. In some embodiments, the lower spacers 22 are secured to the bottom baffle panel 34 and are positioned in place against the boiler drum inner surface 42. In addition to the lower spacers 22, embodiments of the steam separator assembly can include one or more side spacers 38. When installed, one or more side baffle panels 32 can be positioned in mating contact with a side spacer 38. According to some embodiments, the side spacers 38 are securable to the boiler drum inner surface 42, whereas in other embodiments, the side spacers 38 are secured to the bottom side baffle panels 32 and are positioned in place against the boiler drum inner surface 42. In various embodiments, one or more side baffle clips 80 are secured to each side baffle panel 32 and the side baffle panels 25 are maintained within the side baffle clip 80. Such side baffle panels 25 can also be maintained within rail clips 13 as noted above. The side baffle clips 80 can be formed with a slot between two walls for receiving an edge of a baffle panel (e.g., 25) as described elsewhere herein. The side baffle clips 80 may permit sliding engagement with a baffle panel within the slot without latching the baffle panel, to permit ease of installation and disassembly, for example. In this way, the baffle panel may be maintained securely by the rail assembly clips 13 without permanent connection. The side baffle clips 80 can be secured to the side baffle panels 32 using hardware such as a nut and bolt, for example, or by welding or other securing method.

Figure 4:
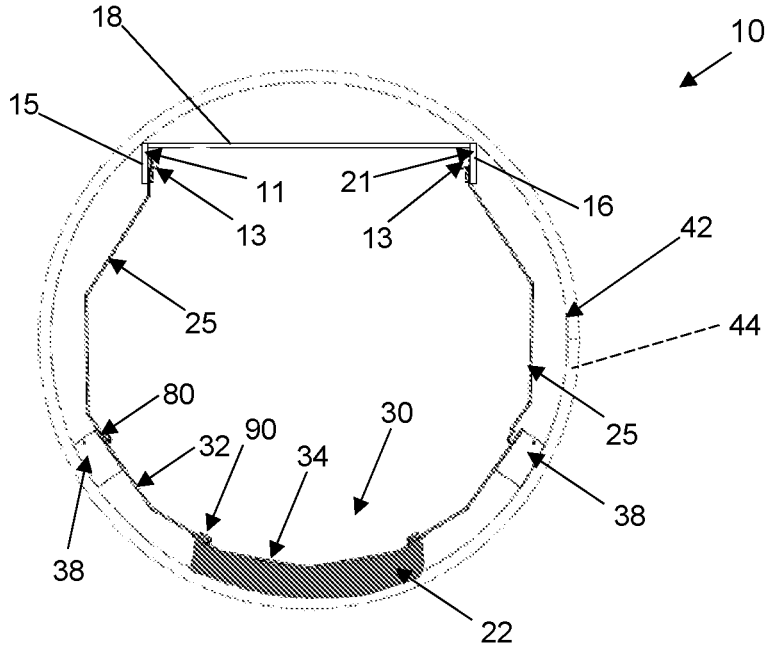
Figure 5:
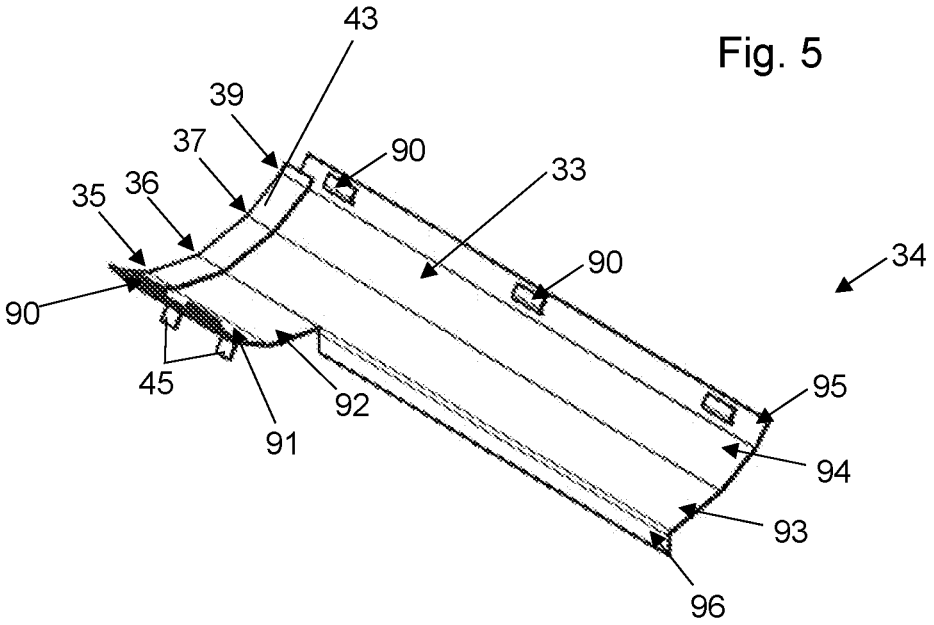
FIG. 5 is a perspective view of a bottom baffle panel in accordance with embodiments of the present disclosure.
Figure 10:
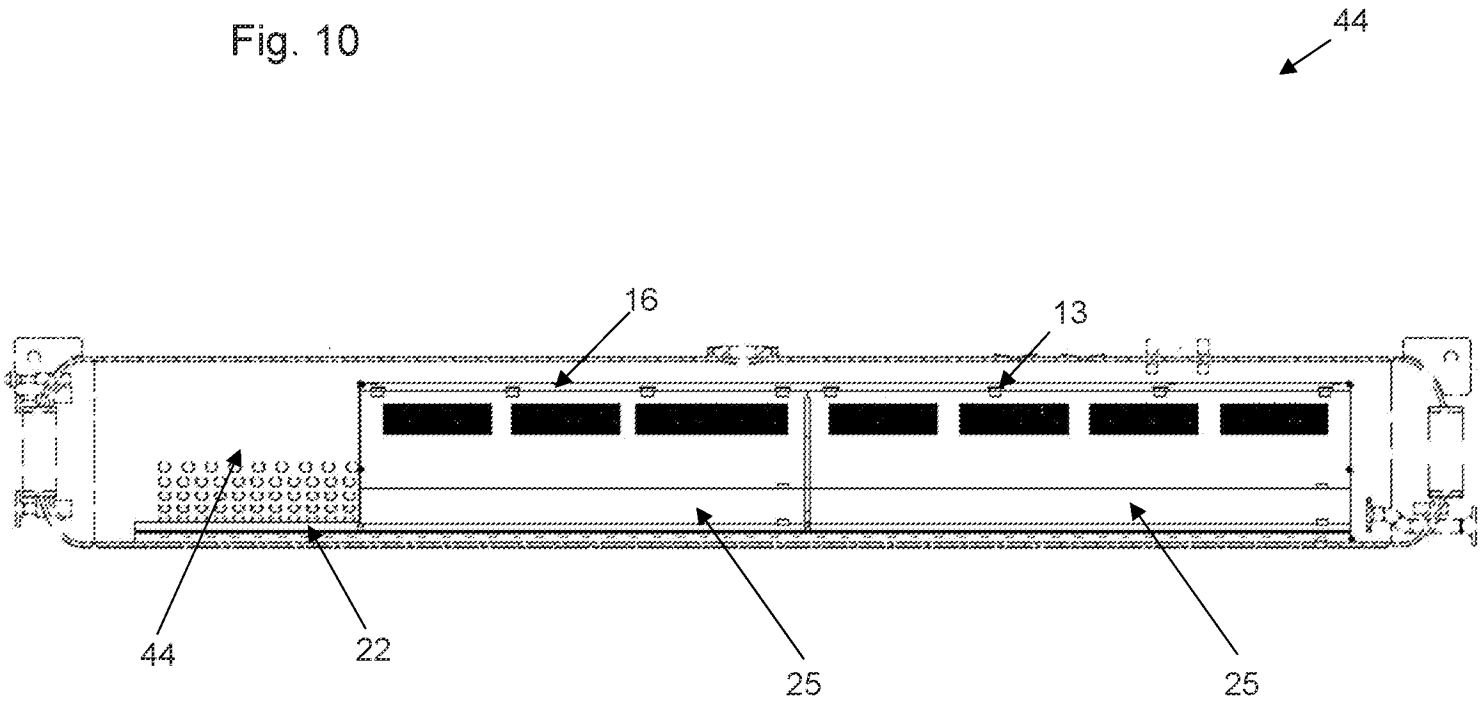
FIG. 10 is a side view of a boiler drum in cross-section, showing elements of a steam separator in accordance with embodiments of the present disclosure.

In various embodiments, a single lower spacer 22 is employed, wherein the lower spacer 22 extends along a portion of the internal circumference of the boiler drum inner surface 42. Regardless of embodiment, the lower spacer 22 can be secured to the interior of the boiler drum through welding or other attachment means. As shown in FIG. 4, the steam separator assembly 10 includes a single lower spacer 22 and two side spacers 38, with the bottom baffle panel 34 positioned atop the lower spacer 22, a side baffle panel 25 in mating contact with one of the side spacers 38, and another side baffle panel 25 positioned in mating contact with a second one of the side spacers 38.

The bottom baffle panel 34 and side baffle panels 25, 32 can be formed of various shapes and designs to facilitate the operations as disclosed herein. For example, as shown in FIGS. 1 through 5, bottom baffle panel 34 can be formed with an angled inner surface 33 having bends such as shown at 35, 36, 37 and 39 extending lengthwise (i.e., horizontally) along the inner surface 33. Bend 35 lies between segment 91 and segment 92. Bend 36 lies between segment 92 and segment 93. Bend 37 lies between segment 93 and segment 94. Bend 39 lies between segment 94 and segment 95. In some embodiments, there are fewer bends such as shown in FIGS. 2 through 4. Bottom tray clips 90 can be secured atop segment 95 and segment 91, for example. Also, spacers 45 can extend from the bottom surface of baffle panel 34 in order to engage the inner surface 42 of the boiler drum 44. In various embodiments, a linking strip 43 is provided to guide adjacent baffle panels in different segments of the steam separator according to the present disclosure. The various bends of the angled inner surface 33 facilitate insertion into an opening in a boiler drum and further assist in channeling water droplets and providing a stable support for side baffle panels 25, 32 when integrated as described herein.

As further shown in FIGS. 1 through 4 and 6 through 8, side baffle panel 25 can be formed with three bend lines 51, 52, 53 that separate substantially horizontal segments 26, 27, 28 and 29. Segment 26 is angled inwardly and engages a bottom tray clip 90 or a side baffle clip 80, depending upon the embodiment, when installed. Upon bending upward from segment 26 as at bend line 51, segment 27 extends substantially vertically when oriented within a boiler drum (e.g., 44) and upon bending inward from segment 27 as at bend line 52, segment 28 extends inwardly within the boiler drum 44 when installed. Segment 28 can also be provided with screens 20 to facilitate the separation of steam from water when steam in injected into the boiler drum during operation. Segment 29 extends substantially vertically from bend line 53 and can engage an upper rail assembly clip 13 as described elsewhere herein. The bend lines 51, 52 and 53 along the side baffle panel(s) 25 facilitate insertion into an opening in a boiler drum as well as structural fit and support for the operations as described herein.

It will be appreciated that the lower spacer 22, side spacer(s) 38 and the upper support rail assembly 18 are securable to a boiler drum inner surface 42 according to embodiments of the presently disclosed device. In various embodiments, a single lower spacer 22 of sufficient size is provided to span the area shown by lower spacer 22 and side spacers 38 in FIG. 3, such that separate side spacers 38 are not employed. In embodiments with side spacers 38, two or more side spacers 38 can be employed and secured or positioned against the inner surface 42 of the boiler drum 44, such that one side baffle panel 25 is in mating contact with one of the side spacers 38 and another side baffle panel 25 is in mating contact with another one of the side spacers 38. In various embodiments, the side spacers 38 are positioned below the center line of the boiler drum 44 and provide additional support for gravitational and fluid weight support purposes. The side spacers 38 can be secured to the interior of the boiler drum through welding or other attachment method, in accordance with embodiments of the present disclosure. As can be seen in FIG. 4, for example, two side baffle panels 25 can be maintained within separate side clips 80 and rail assembly clips 13. In embodiments of the present device as shown in FIGS. 1 through 4, the integrated baffle unit 55 formed by the adjacent baffles can be maintained within the boiler drum 44 so as not to contact the boiler drum inner surface 42.

In operation, a user may install the upper support rail assembly 14 within a boiler drum 44. A user may further insert the spacers 22, 38, bottom tray assembly 30 and baffle panels 25, 32 through a manway in the boiler drum. Once inside the boiler drum 44 with the separator components, the user can secure the spacers 22, 38 in place, such as by welding, for example, with the bottom tray assembly 30 atop the spacer 22. The user may then place a side baffle panel 32 within a bottom tray clip 90 on baffle panel 34 and may place another side baffle panel 25 within a side baffle clip 80 and the upper rail clip 13. The user may then place a different side baffle panel 32 within a different bottom tray clip 90 on baffle panel 34, and may further place another side baffle panel 25 within a different side baffle clip 80 and a different upper rail clip 13 to complete the integrated baffle unit 25.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A steam separator assembly for a boiler, comprising:

an upper support rail assembly comprising a first opposing rail and a second opposing rail, wherein the first opposing rail comprises a first rail inner wall, wherein the second opposing rail comprises a second rail inner wall;

a bottom tray assembly comprising a bottom baffle panel and at least one bottom tray clip secured to the bottom baffle panel;

a plurality of rail assembly clips secured to the upper support rail assembly, wherein a first rail assembly clip of the plurality of rail assembly clips is secured to the first rail inner wall and wherein a second rail assembly clip of the plurality of rail assembly clips is secured to the second rail inner wall; and a plurality of side baffle panels, wherein each of the plurality of side baffle panels is maintained securely by the at least one bottom tray clip or at least one of the plurality of rail assembly clips, whereupon the plurality of side baffle panels and the bottom baffle panel form an integrated baffle unit.

2. The steam separator assembly of claim 1, wherein a first one of the plurality of side baffle panels is maintained securely by the first rail assembly clip and wherein a second one of the plurality of side baffle panels is maintained securely by the second rail assembly clip.

3. The steam separator assembly of claim 1, further comprising a lower spacer, wherein the bottom tray assembly is positioned atop the lower spacer.

4. The steam separator assembly of claim 3, wherein the lower spacer and the upper support rail assembly are securable to a boiler drum inner surface.

5. The steam separator assembly of claim 1, further comprising at least one side spacer, wherein a first one of the plurality of side baffle panels is in mating contact with the at least one side spacer.

6. The steam separator assembly of claim 5, wherein the at least one side spacer and the upper support rail assembly are securable to a boiler drum inner surface.

7. The steam separator assembly of claim 5, further comprising a side baffle clip secured to the first one of the plurality of side baffle panels.

8. The steam separator assembly of claim 7, wherein a second one of the plurality of side baffle panels is maintained securely by the side baffle clip.

9. The steam separator assembly of claim 1, further comprising a lower spacer and at least two side spacers, wherein the bottom tray assembly is positioned atop the lower spacer, wherein a first one of the plurality of side baffle panels is in mating contact with a first one of the at least two side spacers, and wherein a second one of the plurality of side baffle panels is in mating contact with a second one of the at least two side spacers.

10. A boiler device, comprising:

a boiler drum comprising an inner surface; and a steam separator assembly secured within the boiler drum, wherein the steam separator assembly comprises:

a lower spacer maintained against the inner surface of the boiler drum;

a bottom tray assembly in mating contact with the lower spacer and maintained atop the lower spacer, wherein the bottom tray assembly comprises a bottom baffle panel and at least one bottom tray clip secured to the bottom baffle panel;

an upper support rail assembly secured to the inner surface of the boiler drum, wherein the upper support rail assembly comprises a rail comprising a rail inner wall;

at least one rail assembly clip secured to the rail inner wall; and a plurality of side baffle panels, wherein each of the plurality of side baffle panels is maintained securely by the at least one bottom tray clip or the at least one rail assembly clip, whereupon the plurality of side baffle panels and the bottom baffle panel form an integrated baffle unit.

11. The boiler device of claim 10, wherein the steam separator further comprises at least one side spacer secured against the inner surface of the boiler drum, wherein a first one of the plurality of side baffle panels is in mating contact with the at least one side spacer.

12. The boiler device of claim 10, wherein the steam separator further comprises a first side spacer and a second side spacer secured against the inner surface of the boiler drum, wherein a first one of the plurality of side baffle panels is in mating contact with the first side spacer and wherein a second one of the plurality of side baffle panels is in mating contact with the second side spacer.

13. The boiler device of claim 12, further comprising a first side clip secured to the first one of the plurality of side baffle panels and a second side clip secured to the second one of the plurality of side baffle panels, wherein the at least one rail assembly clip comprises a first rail assembly clip and a second rail assembly clip, wherein the plurality of side baffle panels includes a third one of the plurality of side baffle panels maintained securely by the first side clip and the first rail assembly clip, and wherein the plurality of side baffle panels includes a fourth one of the plurality of side baffle panels maintained securely by the second side clip and the second rail assembly clip.

14. The boiler device of claim 10, wherein the integrated baffle unit is maintained within the boiler drum so as not to contact the boiler drum inner surface.

15. A steam separator assembly, comprising:

a lower spacer;

a bottom tray assembly in mating contact with the lower spacer and maintained atop the lower spacer, wherein the bottom tray assembly comprises a bottom baffle panel and at least one bottom tray clip secured to the bottom baffle panel;

an upper support rail assembly, wherein the upper support rail assembly comprises a rail comprising a rail inner wall;

at least one rail assembly clip secured to the rail inner wall; and a plurality of side baffle panels, wherein each of the plurality of side baffle panels is maintained by the at least one bottom tray clip or the at least one rail assembly clip, whereupon the plurality of side baffle panels and the bottom baffle panel form an integrated baffle unit.

16. The steam separator assembly of claim 15, further comprising:

a first side spacer and a second side spacer, and wherein a first one of the plurality of side baffle panels is in mating contact with the first side spacer and wherein a second one of the plurality of side baffle panels is in mating contact with the second side spacer.

17. The steam separator assembly of claim 16, further comprising:

a first side clip secured to the first one of the plurality of side baffle panels;

a second side clip secured to the second one of the plurality of side baffle panels, wherein the at least one rail assembly clip comprises a first rail assembly clip and a second rail assembly clip; and wherein a third one of the plurality of side baffle panels is maintained by the first side clip and the first rail assembly clip, and wherein a fourth one of the plurality of side baffle panels is maintained by the second side clip and the second rail assembly clip.

18. The steam separator assembly of claim 17, wherein the upper support rail assembly comprises a first opposing rail and a second opposing rail, wherein the first rail assembly clip is secured to the first opposing rail and the second rail assembly clip is secured to the second opposing rail.

19. The boiler device of claim 18, wherein each of the third and fourth side baffle panels is formed with at least three bends extending substantially horizontally, therealong.

* * * * *